United States Patent [19]

Redemann

[11] 4,344,581

[45] Aug. 17, 1982

[54] CRUSHING APPARATUS

[75] Inventor: Richard Redemann, Lunen, Fed. Rep. of Germany

[73] Assignee: Gewerkschaft Eisenhutte Westfalia, Fed. Rep. of Germany

[21] Appl. No.: 97,111

[22] Filed: Nov. 20, 1979

[30] Foreign Application Priority Data

Dec. 6, 1978 [DE] Fed. Rep. of Germany ..... 2852662

[51] Int. Cl.³ ..... B02C 19/00

[52] U.S. Cl. ..... 241/88.4; 241/101.7; 241/191; 241/195; 241/223; 241/237

[58] Field of Search ..... 241/88.4, 87, 87.1, 241/223, 237, 280, 101.7, 190, 189 R, 191, 195, 243, 242, 277

[56] References Cited

U.S. PATENT DOCUMENTS

| | | | |
|---|---|---|---|
| 1,459,340 | 6/1923 | Nevill | 241/237 X |
| 2,005,758 | 6/1935 | Shiley | 241/237 X |
| 2,575,057 | 11/1951 | Keiper | 241/223 X |
| 3,540,666 | 11/1970 | Altendorfer | 241/88.4 |

FOREIGN PATENT DOCUMENTS

| | | | |
|---|---|---|---|
| 1132414 | 11/1958 | Fed. Rep. of Germany | 241/237 |
| 1112876 | 8/1961 | Fed. Rep. of Germany . | |
| 1114073 | 9/1961 | Fed. Rep. of Germany . | |

*Primary Examiner*—Mark Rosenbaum

*Attorney, Agent, or Firm*—Neil F. Markva

[57] ABSTRACT

Apparatus for crushing fragments of mineral material comprises a rotary crusher mounted above, and co-operating with, a scraper-chain conveyor. The rotary crusher has a cylindrical body provided with a plurality of first, second and third rows of chisels. The chisels are detachably mounted in holders fixed to the cylindrical body. The chisels are all the same, but the holders are of different sizes so that the chisels of a first set have a longer radial reach than the chisels of second set, which in turn have a longer radial reach than the chisels of a third set. Each first row has chisels of the first and second sets, and each of the second and third rows has chisels of the third set. The provision of the chisels of the first and second sets having longer radial reaches enables the mineral material to be drawn into the crushing gap between the rotary crusher and the scraper-chain conveyor and broken up more efficiently.

16 Claims, 6 Drawing Figures

FIG. 4
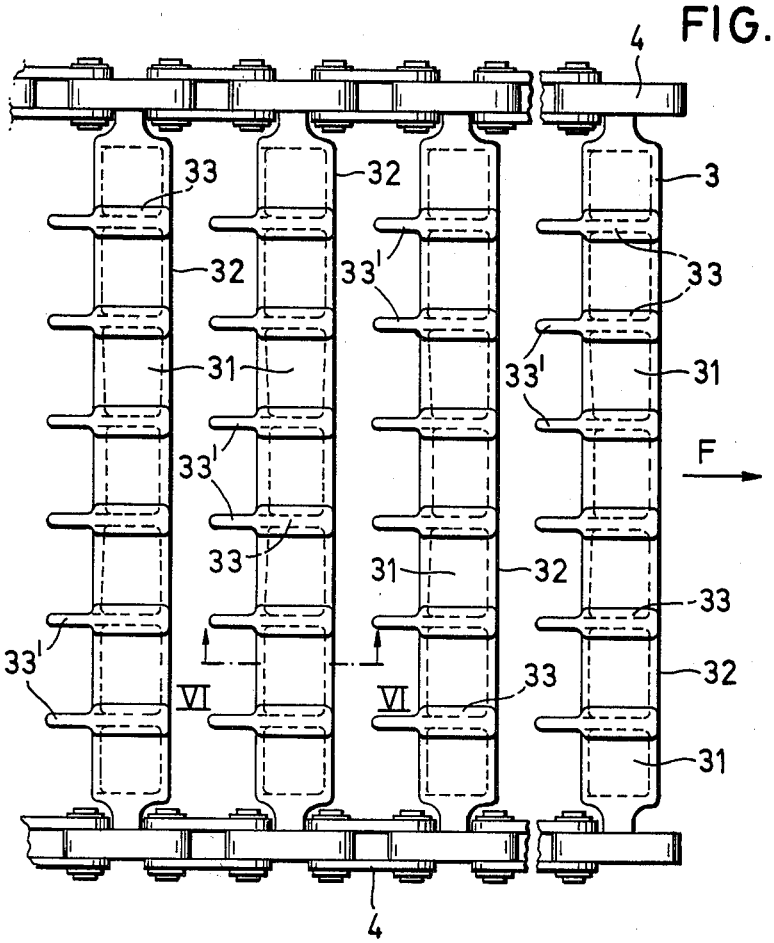
FIG. 5
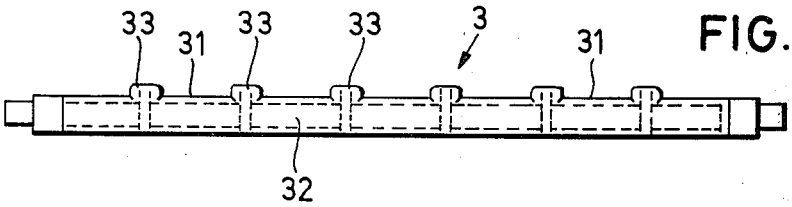
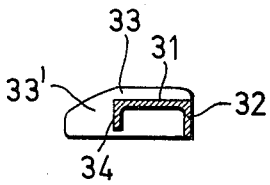
FIG. 6

CRUSHING APPARATUS

BACKGROUND TO INVENTION

This invention relates to apparatus for crushing mineral material, and in particular to such apparatus that can be used with a mineral mining installation such as a scraper-chain conveyor.

Known mining crushing apparatus is used to comminute mined minerals, such as coal, iron ore, salt, potash and gypsum. In these known forms of apparatus, the mine conveyor (usually a scraper-chain conveyor) forms an abutment for a rotary crusher so that the mined material is broken up as it passes through the gap between the crusher and the top surface of the conveyor.

A known type of crushing apparatus has a rotary crusher disposed above, and co-operating with a floor plate. The rotary crusher is provided with a plurality of crushing tools such as chisels, and the floor plate may form part of a scraper-chain conveyor.

The aim of the invention is to provide an improved crushing apparatus of this type.

SUMMARY OF INVENTION

The apparatus for crushing mineral material of the present invention comprises a rotary crusher disposed above, and co-operating with, a floor plate. The rotary crusher includes a cylindrical body and a plurality of chisels detachably fixed thereto. The chisels are arranged in rows with the chisels of at least one row have a longer radial reach than the chisels in the two adjacent rows.

With this form of rotary crusher, large pieces of mineral material that cannot be engaged as they enter the crushing apparatus by the chisels of shorter radial reach, can be engaged by the longer reach chisels at an early stage in the crushing operation. This results in such pieces of material being drawn into the crushing gap where they are crushed by the chisels of shorter reach. The pull through and crushing effects of this type of rotary crusher are, therefore, considerably better than with known crushers.

Advantageously, the rows extend parallel with, or at a small angle to, the axis of the cylindrical body. There may be less rows having chisels of longer, radial reach than rows having chisels of shorter radial reach. Preferably, each row having chisels of longer radial reach is followed by two rows having chisels of shorter radial reach.

A further increase in the pull-through and crushing effects is achieved if the chisels in each row include chisels having differing radial reaches. Advantageously, the rows of chisels are parallel, and the chisels of each row are offset, when looking the direction of rotation of the crusher, with respect to the chisels in the two adjacent rows.

Preferably, a respective row of crushing studs is provided between each pair of adjacent rows of chisels, each crushing stud having a crushing face in the form of an inverted V. The crushing studs help to prevent partially crushed material from being pressed into the areas between the chisels, as well as assisting with the crushing operation.

The chisels, which may be tapered chisels, are preferably each detachably mounted in a respective holder fixed to the cylindrical body. In this case, all the chisels may be identical, the radial reaches of the chisels being varied by varying the sizes of the holders.

The rows of chisels advantageously extend at a small angle to the axis of the cylindrical body, so that the chisels of any given row do not all encounter the mineral material simultaneously. Although it is preferable for the rows to be straight lines, they could curve or have bends.

Advantageously, the floor plate forms part of a scraper-chain conveyor, and the scraper bars of the scraper-chain conveyor, are each provided with a plurality of ribs which extend upwardly and rearwardly therefrom. Preferably, each row of longer reach chisels is arranged so that its chisels pass between these ribs.

BRIEF DESCRIPTION OF DRAWINGS

One form of crushing apparatus constructed in accordance with the invention will now be described, by way of example, with reference to the accompanying drawings, in which:

FIG. 4 is a plan view of the scraper-chain conveyor of the apparatus of FIG. 1;

FIG. 5 is an end elevation of a scraper bar of the scraper-chain conveyor; and FIG. 6 is a cross-section taken on the line VI—VI of FIG. 4.

DESCRIPTION OF PREFERRED EMBODIMENT

Figure 1:
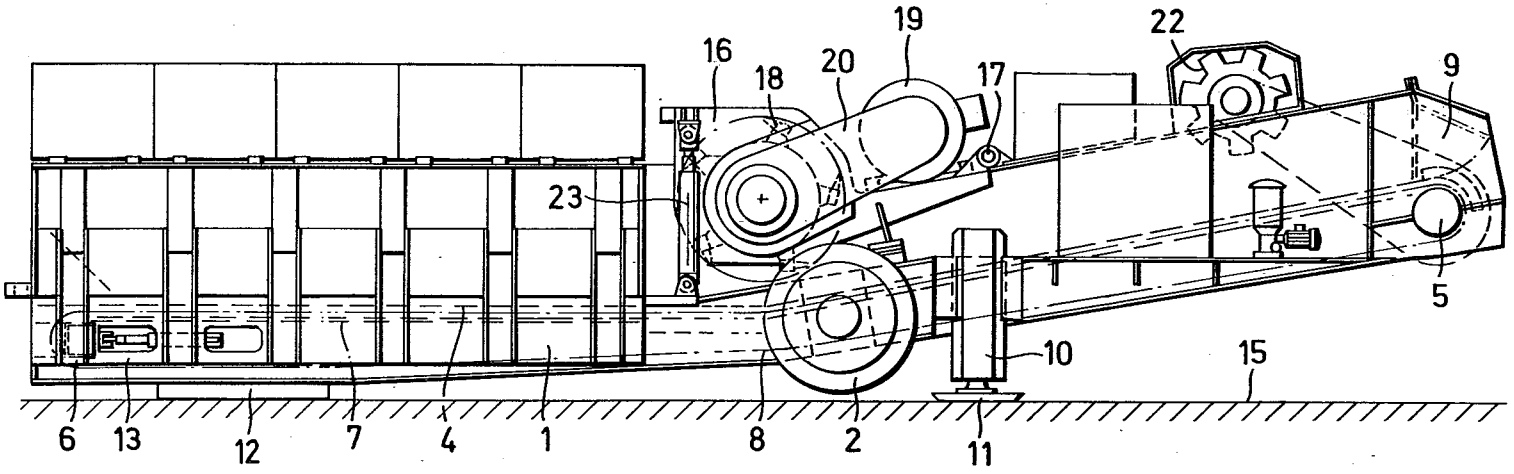
FIG. 1 is a side elevation of the crushing apparatus and shows a rotary crusher and part of a scraper-chain conveyor.

Referring to the drawings, the crushing apparatus has a base frame 1 which forms part of a scraper-chain conveyor (see FIG. 1). The base frame 1 is provided with a pair of wheels 2 which have solid rubber tires and are mounted on the same axle. The scraper-chain conveyor has endless drive chains 4 at each side thereof, these chains being interconnected by scraper bars 3 (see FIGS. 2 and 4 to 6). The chains 4 are driven and reversed respectively at the two ends of the conveyor by way of sprocket drums 5 and 6. The base frame 1 has a floor plate 7 which forms a continuation of the deck plate of the scraper-chain conveyor. The scraper bars 3 run along the floor plate 7.

The base frame 1 (and hence the floor plate 7) is angled at zone 8 at about its center, the wheels 2 being disposed in the zone 8. The base frame 1 is provided with hydraulic rams 10 positioned between the zone 8 and the delivery end 9 of the conveyor, the piston-rods of which are provided with hinged support brackets 11. By extending the rams 10, the apparatus can be lifted at its delivery end 9 to such an extent that the wheels 2 are completely relieved of load. At its opposite end 13, that is to say the feed end, the apparatus is supported over a large area on the ground or the mine working floor 15 by means of a base plate 12 fitted on the underside of the base frame 1. FIG. 1 shows the position of the apparatus during crushing operations with the rams 10 extended and the wheels 2 relieved of load. In this position, the delivery end 9 is raised to such an extent that crushed mined material can be transferred to a downstream conveyor, for example a belt conveyor (not shown). The delivery end 9 is at least 1 meter above floor level.

In this operating position of the apparatus, the scraper-chain conveyor is at least substantially horizontal over the section between the feed end 13 and the zone 8, whereas over the adjoining section between the zone 8 and the delivery end 9 it rises gently towards the horizontal at an angle of between about 10° and 20°.

A frame 16 is pivotably mounted, about a horizontal pivot axis 17, on the base frame 1 above the conveyor, and in the zone 8. A crusher 18 is horizontally and rotatably mounted on the frame 16. The frame 16 also carries an electric motor 19 which drives the crusher 18 via a gear 20. The electric motor 19 also serves to power the sprocket drum 5 of the scraper-chain conveyor.

The frame 16 can be raised and lowered by means of double-acting hydraulic rams 23, so that the width of the crushing gap, formed between the crusher 18 and the floor plate 7, can be adjusted.

Figure 2:
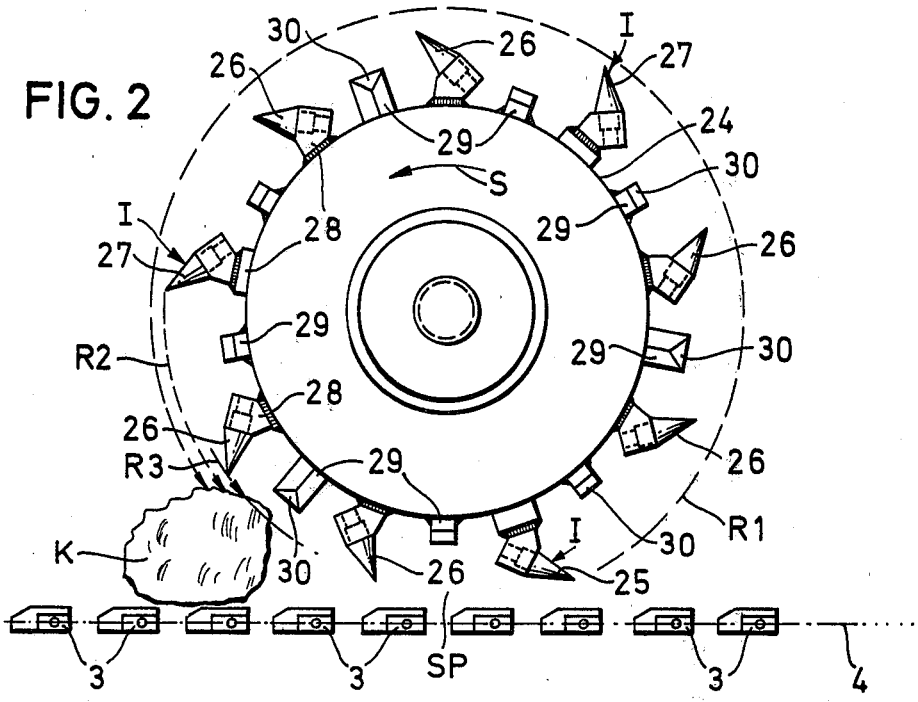
FIG. 2 is a diagrammatic side elevation, on an enlarged scale, of the rotary crusher of the apparatus of FIG. 1.
Figure 3:
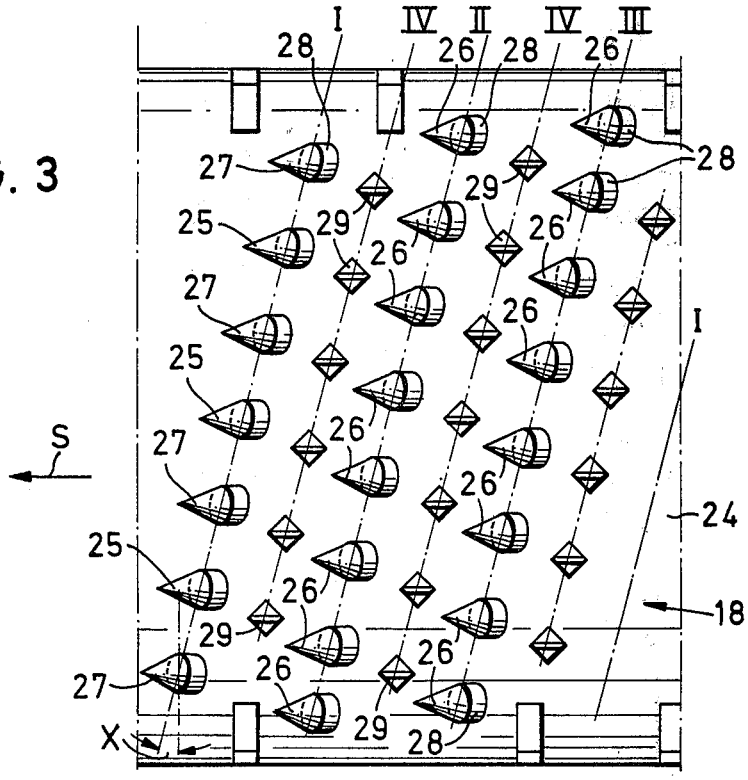
FIG. 3 is an "opened-out" plan view of part of the surface of the rotary crusher of FIG. 2.

Referring to FIGS. 2 and 3, the crusher 18 has a cylindrical body 24 provided with replaceable crushing tools in the form of tapered chisels 25, 26 and 27. The chisels 25, 26 and 27 are detachably mounted in chisel holders 28 fixed to the cylindrical body 24. All the chisels 25, 26 and 27 are of the same shape and size. However, the chisel holders 28 associated with the chisels 25 are larger than the chisel holders 28 associated with the chisels 27 which in turn are larger than the chisel holders associated with the chisels 26, so that the tips of the chisels 25 move along a circular path R1 whose radius is greater than that of the circular paths R2 and R3 along which the tips of the chisels 26 and 27 respectively move (see FIG. 2). Thus, the chisels 25 have the largest radial reach, the chisels 27 the next largest radial reach, and the chisels 26 the smallest radial reach.

As shown in the "opened-out" plan view of FIG. 3, the crushing tools are arranged in three rows I,II and III. Row I contains chisels 27 alternating with chisels 25, whereas rows II and III each contain only chisels 26. Thus, rows I contain chisels 25 and 27 which are the longer radial reach chisels. Seen in the direction S of rotation of the crusher 18, each of the chisels 26 in each of the rows II and III is aligned with a respective gap between two chisels in row I. Each chisel 26 in either of the rows II and III is also aligned with a gap between two chisels 26 in the other of these two rows. As is evident in the drawings, particularly in FIG. 2, the three rows I which contain chisels 25 and 27 are offset or disposed at locations which are spaced by about 120° with respect to each other along the periphery of cylindrical body 24. Arranged between each pair of adjacent rows I,II and II,III are rows IV of crushing studs 29. The crushing studs 29 are fixed to the cylindrical body 24 of the crusher 18, and each stud has a top face 30 in the form of an inverted V. The crushing studs 29 prevent the material being crushed from being pressed into the gaps between the chisels 25,26 and 27 and from being trapped in these areas. The studs 29 also help with the crushing operation carried out by the rotating chisels 25,26 and 27, the floor plate 7 serving as an abutment for taking up the crushing forces. As shown in FIG. 2, some of the studs 29 are larger than the majority of the studs, these larger studs having an extended radial reach.

The crusher body 24 has three of each of the rows I,II and III of chisels, each row I being followed by rows II and III, and each row III being followed by a further row I and so on. Thus, the periphery of the crusher 18 is provided with three equispaced rows I of chisels 25 and 27 having larger radial reaches, and with six rows II and III of chisels 26 having smaller radial reaches. As seen in FIG. 2, when the crusher 18 rotates in the direction of the arrow S, the chisels 25 and then the chisels 27 are the first to strike the fragments K of mineral material to be crushed, these fragments being carried along by the scraper-chain conveyor. These fragments K are either broken up by the chisels 25 and 27 or they are drawn into the crushing gap SP where they are struck by the chisels 26 having the smallest radial reach. Thus, the chisels 25 and 27 break up large fragments K into smaller fragments which in turn are reduced to particle-size by the chisels 26.

As shown in FIG. 3, the chisels 25, 26 and 27 are disposed along their rows I, II and III in straight lines each of which extends at an angle of about 15° to a line parallel to the axis of the cylindrical body 24. Thus, the chisels of any given row do not strike the fragments K simultaneously when the crusher 18 rotates, but do so one after another so that impact stresses on the crusher are minimized. It is, however, also possible to arrange the chisels 25,26 and 27 in curved rows or in rows that bend. In the latter case each row will take the form of an inverted V, the apex of which lies at the middle of the cylindrical surface of the body 24.

Referring now to FIGS. 4 to 6, each of the scraper bars 3 is of generally U-shaped cross-section, and its two ends are attached to the two drive chains 4. Each scraper bar 3 has a top face 31, a leading end face 32 which constitutes a scraping edge, a trailing face 34 and a plurality of rearwardly-extending projections (or ribs) 33. The projections 33 include extensions 33' directed rearwardly of the trailing face 34 and upwardly of the top face 31. The extensions 33' have a width that is less than that of the main parts of the projections 33 (see FIG. 4).

The fragments of mineral material are carried by the scraper-chain conveyor in the direction of the arrow F (see FIG. 4), the fragments lying on the ribs 33 which form an abutment for taking up the crushing forces. The chisel 25 and 27 of longer radial reach are so arranged as to pass between the ribs 33 and to break up the large fragments of mineral material. The chisels 26, on the other hand, are arranged in alignment with the ribs 33. The rearward extensions 33' of the ribs 33 direct the major part of the mineral material on to the main parts of the ribs, and so assist with the crushing operation.

The difference in radial reach between the chisels 25,26 and 27 is, in general, 60 to 120 millimeters, and preferably is 80 to 100 millimeters.

I claim:

1. Apparatus for crushing mineral material, the apparatus comprising:

(a) a rotary crusher disposed above, and cooperating with, a floor plate, (b) the rotary crusher including a cylindrical body and a plurality of chisels detachably fixed thereto, (c) the chisels being arranged in rows with at least one row of the chisels having a first radial reach followed by two adjacent rows of the chisels having a radial reach shorter than the first radial reach, (d) in each row having chisels of the longer first radial reach, said chisels having differing radial reaches with respect to each other.

2. An apparatus according to claim 1 wherein the rows extend at a small angle with respect to the axis of the cylindrical body.

3. An apparatus according to claim 1 wherein there are less rows of chisels having the longer first radial reach than rows of chisels having the shorter radial reach.

4. An apparatus according to claim 1 wherein the rows of chisels are parallel with respect to each other.

5. An apparatus according to claim 1 wherein when looking in the direction of rotation of the crusher, the chisels of each row are offset with respect to the chisels in the two adjacent rows.

6. An apparatus according to claim 1 wherein a respective row of crushing studs is located between each pair of adjacent rows of chisels.

7. An apparatus according to claim 6 wherein each crushing stud has a crushing face in the form of an inverted V.

8. An apparatus according to claim 1 wherein each chisel is detachably mounted in a respective holder fixed to the cylindrical body.

9. An apparatus according to claim 8 wherein all the chisels are identical and the radial reaches of the chisels being varied by varying the sizes of the holders.

10. An apparatus according to claim 1 wherein the floor plate forms part of a scraper-chain conveyor.

11. An apparatus according to claim 10 wherein the scraper bars of the scraper-chain conveyor each includes a plurality of ribs which extend upwardly and rearwardly therefrom.

12. An apparatus for crushing mineral material, the apparatus comprising:

(a) a rotary crusher disposed above, and co-operating with, a floor plate, (b) the rotary crusher including a plurality of chisels detachably fixed to a cylindrical body having a longitudinal axis, (c) the chisels being arranged in rows, and (d) the chisels in three of said rows having a longer radial reach than the chisels in the remaining of said rows, (e) said three rows of chisels of longer radial reach are disposed at locations which are spaced by about 120° with respect to each other along the periphery of the cylindrical body.

13. An apparatus according to claim 12 wherein each one of said three rows includes chisels having a longer radial reach followed by two rows having chisels of shorter radial reach.

14. An apparatus according to claim 12 wherein in each one of said three rows having chisels of the longer radial reach there are chisels which having differing radial reaches with respect to each other.

15. An apparatus according to claim 12 wherein the rows extend at a small angle with respect to the longitudinal axis of the cylindrical body.

16. An apparatus according to claim 12 wherein there are less rows of chisels having the longer radial reach than rows of chisels having the shorter radial reach.

* * * * *